US005388643A

United States Patent [19]

Yee et al.

[11] Patent Number: 5,388,643

[45] Date of Patent: Feb. 14, 1995

[54] COALBED METHANE RECOVERY USING PRESSURE SWING ADSORPTION SEPARATION

[75] Inventors: Dan Yee, Tulsa, Okla.; Rajen Puri, Aurora, Colo.

[73] Assignee: Amoco Corporation, Chicago, Ill.

[21] Appl. No.: 147,125

[22] Filed: Nov. 3, 1993

[51] Int. Cl.[6] ..... F21B 43/18; F21B 43/26; F21B 43/40

[52] U.S. Cl. ..... 166/266; 95/138; 166/268; 166/271

[58] Field of Search ..... 166/266, 267, 268, 271, 166/305.1; 95/138

[56] References Cited

U.S. PATENT DOCUMENTS

| | | | |
|---|---|---|---|
| 3,142,547 | 7/1964 | Marsh et al. . | |
| 3,237,377 | 3/1966 | Skarstrom . | |
| 3,430,418 | 3/1969 | Wagner . | |
| 3,564,816 | 2/1971 | Batta . | |
| 3,636,679 | 1/1972 | Batta . | |
| 4,043,395 | 8/1977 | Every et al. | 166/263 |
| 4,400,034 | 8/1983 | Chew | 299/5 |
| 4,446,921 | 5/1984 | Coenen et al. | 166/267 |
| 4,544,037 | 10/1985 | Terry | 166/369 |
| 4,576,614 | 3/1986 | Armond et al. | 95/138 X |
| 4,756,367 | 7/1988 | Puri et al. | 166/263 |
| 4,883,122 | 11/1989 | Puri et al. | 166/263 |
| 5,014,785 | 5/1991 | Puri et al. | 166/263 |
| 5,014,788 | 5/1991 | Puri et al. | 166/308 |
| 5,015,271 | 5/1991 | Reiss | 95/138 X |
| 5,085,274 | 2/1992 | Puri et al. | 166/252 |
| 5,099,921 | 3/1992 | Puri et al. | 166/266 |
| 5,133,406 | 7/1992 | Puri | 166/266 |
| 5,147,111 | 9/1992 | Montgomery | 299/16 |

FOREIGN PATENT DOCUMENTS 609917 6/1978 U.S.S.R. .

OTHER PUBLICATIONS

M. G. Zabetakis, et al., "Methane Control in United States Coal Mines-1972", U. S. Bureau of Mines, Information Circular 8600, pp. 8-16, (1973).

R. S. Metcalfe, D. Yee, J. P. Seidle, and R. Puri, "Review of Research Efforts in Coalbed Methane Recovery", SPE 23025, (1991).

M. D. Stevenson, W. V. Pinczewski and R. A. Downey, "Economic Evaluation of Nitrogen Injection for Coalseam Gas Recovery", SPE 26199, (1993).

N. Ali, P. K. Singh, C. P. Peng, G. S. Shiralkar, Z. Moschovidis and W. L. Baack, "injection Above-Parting-Pressure Waterflood Pilot, Valhall Field, Norway", SPE 22893, (1991).

R. Puri and D. Yee, "Enhanced Coalbed Methane Recovery", SPE 20732, (1990).

Brian Evison and R. E. Gilchrist, "New Developments in Nitrogen in the Oil Industry", SPE 24313, (1992).

Alan A. Reznik, Pramod K. Singh and William L. Foley, "An Analysis of the Effect of Carbon Dioxide Injection on the Recovery of In-Situ Methane from Bituminous Coal: An Experimental Simulation", SPE/DOE 10822, (1982).

Ralph W. Veatch, Jr., Zissis A. Mosachovidis and C. Robert Fast, "An Overview of Hydraulic Fracturing", *Recent Advances in Hydraulic Fracturing*, vol. 12, chapter 1, pp. 1-38, S.P.E. Monograph Series, (1989).

N. R. Warpinski and Michael Berry Smith, "Rock Mechanics and Fracture Geometry", *Recent Advances in Hydraulic Fracturing*, vol. 12, chapter 3, pp. 57-80, S.P.E. Monograph Series, (1989).

"Quarterly Review of Methane from CoalSeams Technology", *Gas Research Institute*, vol. 11, No. 1, p. 38, (1993).

(List continued on next page.)

*Primary Examiner*—George A. Suchfield
*Attorney, Agent, or Firm*—Charles P. Wakefield; Richard A. Kretchmer; Scott P. McDonald

[57] ABSTRACT

A method is disclosed for using a pressure swing adsorption separator system to provide an oxygen-depleted gaseous effluent for injecting into a suitable solid carbonaceous subterranean formation, such as a coalbed, to enhance the recovery of methane from the formation.

31 Claims, 2 Drawing Sheets

OTHER PUBLICATIONS

Carl L. Schuster, "Detection Within the Wellbore of Seismic Signals Created by Hydraulic Fracturing", SPE 7448, (1978).

Amoco Production Company, Handout distributed at the International Coalbed Methane Symposium held in Birmingham, Ala., May 17-21, 1993.

Application for Enhanced Recovery Nitrogen Injection Pilot and Approval of Aquifer Exemption, submitted to the Colorado Oil and Gas Conservation Commission, Aug. 30, 1990.

Durango Herald Newspaper Article, "Planners OK Amoco Facilities", dated May 15, 1991.

La Plata County Planning Commission, Colorado Planning Commission Information Session of Mar. 1991 dealing with Amoco's Planned Nitrogen Injection Pilot.

United States Environmental Protection Agency Region VIII, Transmittal Letter of Feb. 11, 1992 approving Nitrogen Injection Pilot and Associated Permits.

Nov. 9, 1990, Report of the Oil and Gas Conservation Commission of the State of Colorado.

Donald H. White, Jr. and P. Glenn Barkley, "The Design of Pressure Swing Adsorption Systems", *Chemical Engineering Progress*, pp. 25-33, Jan. 1989.

Mark W. Ackley and Ralph T. Yang, "Kinetic Separation by Pressure Swing Adsorption: Method of Characteristics Model", *AIChE Journal*, vol. 36, No. 8, pp. 1229-1238, (1990).

Douglas M. Ruthven, "Principles of Adsorption and Adsorption Processes", A Wiley-Interscience Publication, Publisher, John Wiley & Sons, pp. 359-375, (1984).

H. S. Shin and K. S. Knaebel, "Pressure Swing Adsorption: An Experimental Study of Diffusion-Induced Separation", *AIChE Journal*, vol. 34, No. 9, pp. 1409-1416, (1988).

S. Farooq and D. M. Ruthuen, "Effect of Equilibrium Selectivity in a Kinetically Controlled PSA Separation", *Chemical Engineering Science*, vol. 47, No. 8, pp. 2093-2094, (1992).

COALBED METHANE RECOVERY USING PRESSURE SWING ADSORPTION SEPARATION

FIELD OF THE INVENTION

The present invention is directed to a method of recovering coalbed methane from a solid carbonaceous subterranean formation, such as a coalbed, and, more particularly, to inputting a gas containing at least 60 volume percent nitrogen and at least 15 volume percent oxygen into a pressure swing adsorption separator, withdrawing an oxygen-depleted effluent from the separator, injecting the oxygen-depleted effluent into the solid carbonaceous subterranean formation, and recovering methane from the solid carbonaceous subterranean formation.

BACKGROUND OF THE INVENTION

It is believed that methane is produced during the conversion of peat to coal. The conversion is believed to be a result of naturally occurring thermal and biogenic processes. Because of the mutual attraction between the carbonaceous matrix of coal and the methane molecules, a large amount of methane can remain trapped in-situ as gas adhered to the carbonaceous products formed by the thermal and biogenic processes. In addition to methane, lesser amounts of other compounds such as water, nitrogen, carbon dioxide, and heavier hydrocarbons, and sometimes small amounts of other fluids such as argon and oxygen, can be found within the carbonaceous matrix of the formation. The gaseous fluids which are produced from coal formations collectively are often referred to as "coalbed methane." Coalbed methane typically comprises more than about 90 to 95 volume percent methane. The reserves of such coalbed methane in the United States and around the world are huge. Most of these reserves are found in coal beds, but significant reserves may be found in gas shales and other solid carbonaceous subterranean formations believed to result from the action of thermal and biogenic processes on decaying organic matter.

Methane is the primary component of natural gas, a widely-used fuel source. Coalbed methane is now produced from coal seams for use as a fuel. Typically, a wellbore is drilled which penetrates one or more coal seams. The wellbore is utilized to recover coalbed methane from the seam or seams. The pressure difference between a coal seam and the wellbore provides the driving force for flowing coalbed methane to and out the wellbore. Reduction of pressure in the coal seam as coalbed methane is produced increases desorption of methane from the carbonaceous matrix of the formation, but, at the same time, deprives the system of the driving force necessary to flow coalbed methane to the wellbore. Consequently, this method loses its effectiveness over time for producing recoverable coalbed methane reserves. It is generally believed that this method is only capable of economically producing about 35 to 70% of the methane contained in a coal seam.

An improved method for producing coalbed methane is disclosed in U.S. Pat. No. 5,014,785 to Purl, et al. In this process, a methane-desorbing gas such as an inert gas is injected into a solid carbonaceous subterranean formation through at least one injection well, with a methane-containing gas recovered from at least one production well. The desorbing gas, preferably nitrogen, mitigates depletion of pressure within the formation and is believed to desorb methane from the carbonaceous matrix of the formation by decreasing the methane partial pressure within the formation. This method is effective for increasing both the total amount and rate of methane production from a solid carbonaceous subterranean formation such as a coal seam. Present indications are that the rate of methane production can be increased and that the total amount of methane recovered can be increased substantially, possibly up to 80% or more of the methane contained in the formation.

Puri, et al., U.S. Pat. No. 5,014,785, further discloses that air is a suitable source of nitrogen for increasing methane production. However, injecting an oxygen-containing gas, such as air, into a solid carbonaceous subterranean formation, such as a coal seam, to increase production of methane can present problems. Oxygen can cause corrosion and rust formation in well casings and other fluid conduits. Also, injected oxygen-containing gases are potentially flammable. It is desirable to provide an economically attractive method to minimize these potential problems by depleting the oxygen content of air before injecting the oxygen-depleted air into a solid carbonaceous subterranean formation, such as a coal seam, for increasing methane production.

U.S. Pat. No. 5,133,406 to Purl, et al., discloses depleting the oxygen content of air before injecting air into a coal seam by putting air and a source of fuel, such as methane, into a fuel cell power system, generating electricity, and forming a fuel cell exhaust comprising oxygen-depleted air. While this system is advantageous for producing oxygen-depleted air at remote locations, particularly where there is need for generating electricity for on-site needs, there is a need for less expensive methods of producing oxygen-depleted air suitable for use in the production of coalbed methane, particularly where there is not a need for additional on-site electricity.

As used herein, the following terms shall have the following meanings:

(a) "adsorbate" is that portion of a gaseous mixture which is preferentially adsorbed by a bed of adsorptive material during the adsorptive portion of a pressure swing adsorption separator's cycle.

(b) "air" refers to any gaseous mixture containing at least 15 volume percent oxygen and at least 60 volume percent nitrogen. Preferably "air" is the atmospheric mixture of gases found at the well site and contains between about 20 and 22 volume percent oxygen and between about 78 and 80 volume percent nitrogen.

(c) "cleat" or "cleat system" is the natural system of fractures within a solid carbonaceous subterranean formation.

(d) a "coalbed" comprises one or more coal seams in fluid communication.

(e) "formation parting pressure" and "parting pressure" mean the pressure needed to open a formation and propagate an induced fracture through the formation.

(f) "fracture half-length" is the distance, measured along a fracture, from a wellbore to a tip of the fracture.

(g) "preferentially adsorbing", "preferentially adsorbs", and "preferential adsorption" refer to processes that alter the relative proportions of the components of a gaseous fluid. The processes fractionate a mixture of gases by equilibrium separation, kinetic separation, steric separation, and any other process or combinations of processes which within a bed of material would selectively fractionate a mixture of gases into an oxygen-depleted fraction and an oxygen-enriched fraction.

(h) "raffinate" refers to that portion of the gas injected into a bed of adsorptive material which is not preferentially adsorbed by the bed of adsorptive material.

(i) "recovering" means a controlled collection and/or disposition of a gas, such as storing the gas in a tank or distributing the gas through a pipeline. "Recovering" specifically excludes venting the gas into the atmosphere.

(j) "reservoir pressure" means the pressure of a productive formation near a well during shut-in of that well. The reservoir pressure of the formation may change over time as oxygen-depleted effluent is injected into the formation.

(k) "solid carbonaceous subterranean formation" refers to any substantially solid, methane-containing material located below the surface of the earth. It is believed that these solid, methane-containing materials are produced by the thermal and biogenic degradation of organic matter. Solid carbonaceous subterranean formations include but are not limited to coalbeds and other carbonaceous formations such as shales.

(l) "steric separation" occurs in some zeolitic materials where one or more components of a gas mixture are excluded from entering the internal structure of the particles utilized in a bed of such material.

(m) "well spacing" or "spacing" is the straight line distance between the individual wellbores of a production well and an injection well. The distance is measured from where the wellbores intercept the formation of interest.

SUMMARY OF THE INVENTION

The general object of this invention is to provide a method for recovering methane from solid carbonaceous subterranean formations. A more specific object of this invention is to provide a method for generating an oxygen-depleted effluent for use in recovering methane from a solid carbonaceous subterranean formation. Other objects of the present invention will appear hereinafter.

One embodiment of the invention is a method for recovering methane from a solid carbonaceous subterranean formation having a production well in fluid communication with the formation and an injection well in fluid communication with the formation, the method comprising the steps of:

(a) injecting a gaseous fluid containing at least 60 volume percent nitrogen and at least 15 volume percent oxygen into a bed of adsorptive material which preferentially adsorbs oxygen over nitrogen to establish a total pressure on the bed of adsorptive material;

(b) removing a raffinate, comprising an oxygen-depleted effluent, from the bed;

(c) injecting the oxygen-depleted effluent from step b) into the formation through the injection well;

(d) recovering a fluid comprising methane through the production well; and (e) operating the production well so that a pressure in the production well at a wellbore location adjacent to the formation is less than an initial reservoir pressure of the formation.

In a second embodiment of the invention, a method is disclosed for recovering methane from a coalbed having a production well in fluid communication with the coalbed and an injection well in fluid communication with the coalbed, the method comprising the steps of:

(a) injecting a gaseous fluid containing at least 60 volume percent nitrogen and at least 15 volume percent oxygen into a bed of adsorptive material which preferentially adsorbs oxygen over nitrogen to establish a total pressure on the bed of adsorptive material;

(b) removing a raffinate, comprising an oxygen-depleted effluent containing less than 95% by volume nitrogen, from the bed;

(c) injecting the oxygen-depleted effluent from step b)into the coalbed through the injection well; and (d) recovering a fluid comprising methane through the production well.

In a third embodiment of the invention, a method is disclosed for recovering methane from a solid carbonaceous formation having a production well in fluid communication with the formation and an injection well in fluid communication with the formation, the method comprising the steps of:

a) injecting air into a first bed of adsorptive material which preferentially adsorbs oxygen over nitrogen to establish a total pressure on the first bed;

(b) removing a raffinate, comprising an oxygen-depleted effluent, from the first bed;

(c) lowering the total pressure on the first bed, after a desired degree of saturation of the first bed is obtained, to cause gases adsorbed in step a) which are enriched in oxygen to desorb from the first bed;

(d) concurrently with desorbing the gases from the first bed, injecting air into a second bed of adsorptive material which preferentially adsorbs oxygen over nitrogen to establish a total pressure on the second bed;

(e) removing a raffinate, comprising an oxygen-depleted effluent from the second bed;

(f) concurrently with step a), lowering the total pressure on the second bed, after a desired degree of saturation of the second bed is obtained, to cause gases adsorbed in step d) which are enriched in oxygen to desorb from the second bed;

(g) injecting the oxygen-depleted effluent removed in steps b) and e) into the solid carbonaceous subterranean formation through the injection well;

(h) removing the gases desorbed in steps c) and f) from the from the first and second beds of adsorptive material; and (i) recovering a fluid comprising methane through the production well.

In a fourth embodiment of the invention, a method is disclosed for at least doubling the rate of recovery of methane from a production well penetrating a coalbed and producing A standard cubic feet of methane per day, which comprises the steps of:

(a) processing air containing about 15 to 25% by volume oxygen through a pressure swing adsorption separator to produce an oxygen-depleted effluent; and (b) injecting the oxygen-depleted effluent into the coalbed through an injection well at a pressure lower than a parting pressure of the coalbed at a rate sufficient to increase the production of methane from the production well to at least 2A standard cubic feet of methane per day.

In a fifth embodiment of the invention, a method is disclosed for increasing the production of methane from a coalbed penetrated by an injection well and a production well, which comprises the steps of:

(a) recovering methane from a first production well at A standard cubic feet per day;

(b) processing air containing about 15 to 25% by volume oxygen through a pressure swing adsorption separator to produce an oxygen-depleted effluent; and (c) injecting the oxygen-depleted effluent through the injection well at a rate sufficient to increase the recovery of methane from the first production well to at least 2A standard cubic feet per day within 90 days of the first injection of oxygen-depleted effluent.

The invention provides an oxygen-depleted effluent with most of the advantages of pure nitrogen, but which is less expensive to produce than pure nitrogen. Additionally, with the invention, nitrogen does not have to be transported to the methane production site nor does an expensive cryogenic air separation plant have to be provided on-site for separating nitrogen from air. The invention can utilize portable pressure swing adsorption separators which are easily transferred to another portion of a field under production or to another coalbed methane field. Injecting oxygen-depleted effluent into a solid carbonaceous subterranean formation which is producing methane reduces the potential for rust formation and corrosion in piping, production equipment, and wellbore casing; and using oxygen-depleted effluent reduces the potential of fire or explosion in the injection equipment. Further, pressure swing adsorption separators are less expensive than fuel cell power systems.

Numerous other advantages and features of the present invention will become readily apparent from the following detailed description of the invention, the embodiments described therein, the claims, and the accompanying drawings.

DETAILED DESCRIPTION OF THE INVENTION

Figure 1:
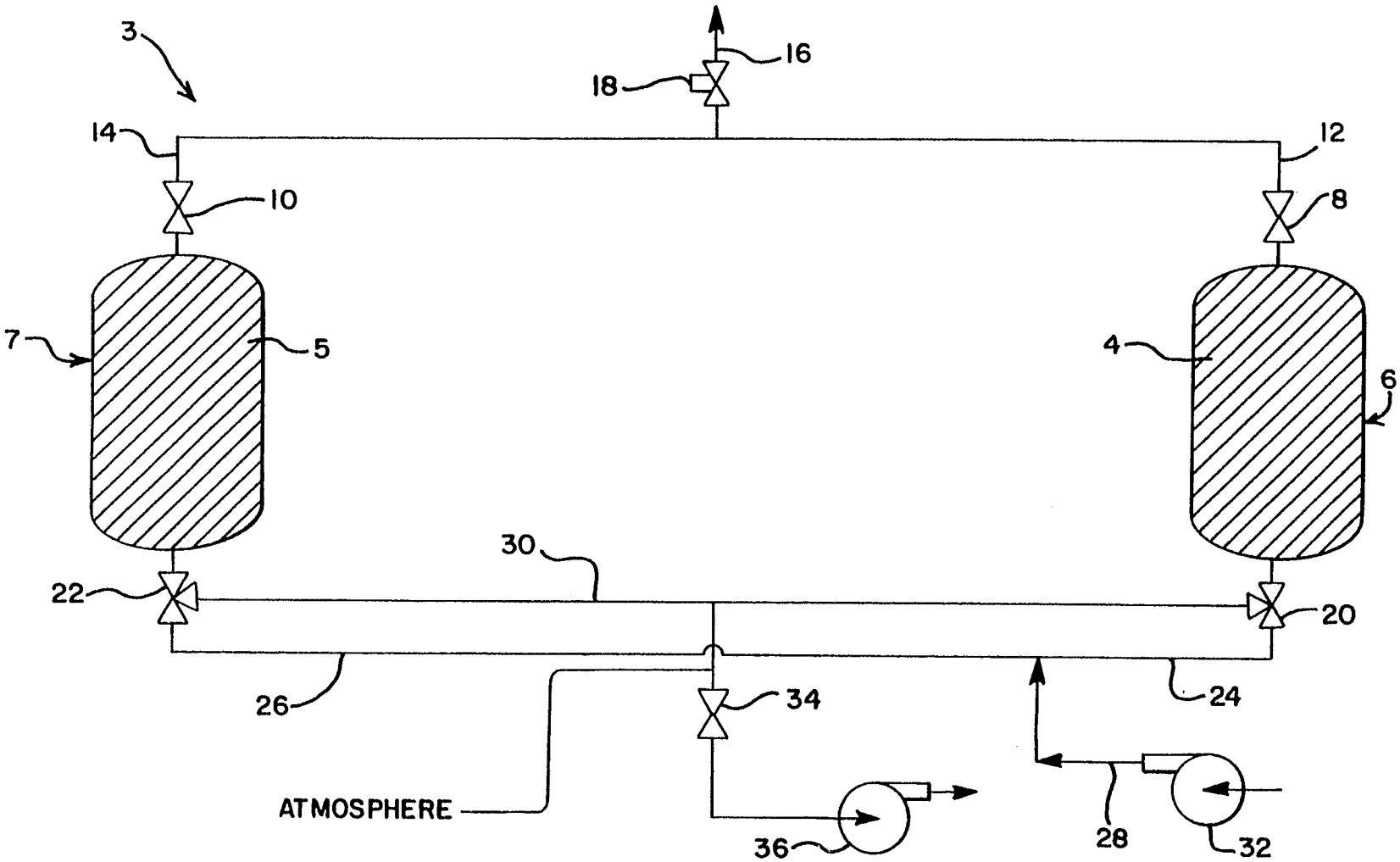
FIG. 1 is a schematic diagram of a representative carbon molecular sieve pressure swing adsorption separator as utilized in one embodiment of the invention.

While this invention is susceptible of embodiment in many different forms, there is shown in the drawing, and will herein be described in detail, specific embodiments of the invention. It should be understood, however, that the present disclosure is to be considered an exemplification of the principles of the invention and is not intended to limit the invention to the specific embodiments illustrated.

During the operation of the pressure swing adsorption separator, a gaseous fluid containing at least 60 volume percent nitrogen and at least 15 volume percent oxygen is injected into a bed of adsorptive material to establish a total pressure on the bed of adsorptive material. This is commonly referred to as the "adsorption portion" of a pressure swing adsorption cycle. The injection of gaseous fluid is continued until a desired saturation of the bed of material is achieved. The desired adsorptive saturation of the bed of material can be determined by routine experimentation. While the gaseous fluid is being injected into the bed of adsorptive material, an oxygen-depleted effluent (raffinate) is withdrawn from the separator. A total pressure is maintained on the bed of adsorptive material while raffinate is withdrawn. Maintaining pressure on the bed will ensure that the injected gaseous fluid is efficiently fractionated into an oxygen-depleted fraction and an oxygen-enriched fraction.

Once the desired adsorptive saturation of the bed is obtained, the material's adsorptive capacity can be regenerated by reducing the total pressure on the bed of material. The reduction of the pressure on the bed is commonly referred to as the "desorption portion" of a pressure swing adsorption cycle. A desorbed gaseous effluent, which is enriched in oxygen, is released from the bed of adsorptive material while the separator is operating in the desorption portion of its cycle. This desorbed gaseous effluent is referred to as an "adsorbate." The adsorbate is released from the bed of adsorptive material due to the reduction in total pressure which occurs within the bed during the desorptive portion of a pressure swing adsorption separator's cycle. If desired, the bed of material may be purged before the adsorption portion of the cycle is repeated to maximize adsorbate removal from the bed.

In general, the pressure utilized during the adsorption portion of the cycle and the differential pressure utilized by the adsorptive separator are selected so as to optimize the separation of the nitrogen from oxygen. The differential pressure utilized by the adsorption separator is the difference between the pressure utilized during the adsorption portion of the cycle and the pressure utilized during the desorption portion of the cycle. In general, the higher the pressure utilized, the more gas which can be adsorbed by the bed of adsorptive material. For a given system, the faster the removal of oxygen-depleted effluent from the system, the higher the oxygen content in the oxygen-depleted effluent.

The cost of pressurizing the injected gaseous fluid is important to consider when determining what pressures to be used with the separator. The flow rate of the oxygen-depleted effluent removed during the adsorption portion of the cycle must be high enough to provide an adequate flow but low enough to allow for adequate separation of the gaseous fluid into its components. Where flammability in the injection wellbore due to the presence of oxygen in the oxygen-depleted effluent is an important consideration, the pressure swing adsorption separator preferably should be operated to provide an oxygen-depleted effluent having a nitrogen-to-oxygen volume ratio of about 9:1 to about 99:1. It is more preferable to operate the pressure swing adsorption separator to provide an oxygen-depleted effluent having from about 2 to 8% by volume oxygen.

Where flammability in the injection wellbore due to the presence of oxygen in the oxygen-depleted effluent is not an important consideration, the pressure swing adsorption separator is preferably operated to provide a relatively high flow of oxygen-depleted effluent having up to 94.9 volume percent nitrogen. Although commercial pressure swing adsorption separators are typically configured to provide oxygen-depleted effluent having between 95 and 99.1 volume percent nitrogen, it is believed that reconfiguring a pressure swing adsorption separator system to provide an oxygen-depleted effluent having 94.9 or less volume percent nitrogen will greatly increase the quantity of oxygen-depleted effluent produced from the separator as compared to standard commercial separators. This will greatly reduce the processing costs for producing oxygen-depleted effluent using a pressure swing adsorption separator system. For example, it is believed that decreasing the nitrogen volume percent in the oxygen-depleted effluent from 95% to 93% may result in a 15% increase in the flow rate of oxygen-depleted effluent for a given pressure swing adsorption separator.

Adsorptive Beds of Material

The types of materials that can be utilized in a pressure swing adsorption separator include any carbonaceous, alumina-based, silica-based, zeolitic, and other metallic-based materials that can preferentially adsorb a given component of a gaseous mixture. Each of these general classes has numerous variations characterized by their material composition, method of activation, and the selectivity of adsorption they exhibit. Examples of materials which can be utilized for the bed of adsorptive material are zeolites, having sodium alumina silicate compositions such as "4A"-type zeolite and "RS-10" (a zeolite molecular sieve manufactured by Union Carbide Corporation), carbon molecular sieves, activated carbon and other carbonaceous beds of material. In the preferred embodiment of the invention, a bed of adsorptive material is used which preferentially adsorbs oxygen over nitrogen. Also, in the preferred embodiment of the invention, more than one bed of adsorptive material is utilized so that one bed of material may be operating in the adsorption portion of its cycle while another bed of material is operating in the desorption portion of its cycle or is being purged. This method of operation will provide a continuous supply of oxygen-depleted effluent.

In the preferred embodiment of the invention, a carbon molecular sieve material is utilized for the bed of adsorptive material. Examples of separators which utilize carbon molecular sieve materials are the "NCX" Series of pressure swing adsorption separator systems, which are manufactured by Generon Systems, a joint venture of Dow Chemical Company and the BOC Group. Vacuum desorption is preferably utilized to purge the bed of adsorptive material prior to restarting the adsorptive portion of the cycle. The pressure swing adsorption separator commonly operates between a pressure of about 4 atmospheres during the adsorption portion of the cycle and about 0.1 atmospheres during the desorption portion of the cycle.

Referring to FIG. 1, which is a schematic diagram of a carbon molecular sieve pressure swing adsorption separator 3, the beds of adsorptive material 4 and 5 comprising carbon molecular sieve material are contained within pressure vessels 6 and 7, respectively. Pressure vessels 6 and 7 have respective isolation valves 8 and 10, located on their respective discharge piping 12 and 14. Discharge piping 12 and 14 combine into a common nitrogen production piping 16 located downstream of isolation valves 8 and 10. Nitrogen production piping 16 carries an oxygen-depleted effluent stream which is to be injected into a solid carbonaceous subterranean formation. Common nitrogen production piping 16 has a throttle valve 18 which is adjusted to control the removal rate of oxygen-depleted effluent from the pressure swing adsorption system and to maintain the total pressure on the bed of adsorptive material at the desired value. Three-way valves 20 and 22 are located on inlet piping 24 and 26. Three-way valves 20 and 22 isolate pressure vessels 6 and 7 from compressor discharge piping 28. The three-way valves also isolate pressure vessels 6 and 7 from a depressurization/purge line 30. A vacuum pump may be installed in common discharge/purge line 30, if desired, to utilize vacuum desorption to purge the bed of adsorptive material prior to restarting the adsorption portion of the cycle.

The pressure swing adsorption separator can be operated, for example, in the following manner. Compressor 32 discharges pressurized gaseous fluid containing at least 60 volume percent nitrogen and at least 15 volume percent oxygen into compressor discharge piping 28. Three-way valve 20 is positioned to direct the pressurized gaseous fluid into pressure vessel 6. The bed of material 4 contained within pressure vessel 6 preferentially adsorbs the oxygen over the nitrogen and fractionates the gaseous fluid into an oxygen-depleted fraction and an oxygen-enriched fraction. As the pressurized gaseous fluid is being directed into pressure vessel 6, an oxygen-depleted effluent, the raffinate, is removed from pressure vessel 6 through isolation valve 8. Throttle valve 18 is positioned so that the recovered oxygen-depleted effluent preferably has a nitrogen-to-oxygen volume ratio of about 9:1 to about 99:1. Injection of pressurized gaseous fluid into pressure vessel 6 is continued until the bed of material in pressure vessel 6 reaches a desired degree of saturation. The desired degree of saturation can be determined by running the pressure swing adsorption separator through a trial run to determine how long it takes to saturate the bed of material. Using this information, how much gaseous fluid to inject to achieve the desired degree of saturation of the bed can be calculated. Once the desired degree of saturation is reached, the system is realigned to direct the discharge of the compressor to pressure vessel 7 and to withdraw an oxygen-depleted effluent from pressure vessel 7. During this phase of operation, isolation valve 8 is shut to isolate pressure vessel 6 from discharge piping 12 and the common oxygen-depleted effluent production piping 16. Three-way valve 20 is positioned to connect pressure vessel 6 to the common depressurization/purge line 30. An oxygen-enriched effluent, the adsorbate, which is carried by the depressurization/purge line 30, may either be vented to the atmosphere or may be used in an on-site process which requires oxygen-enriched effluent. Pressure vessel 6 may be purged by vacuum desorption if desired. A vacuum purge is accomplished by opening vacuum isolation valve 34 and drawing a vacuum on pressure vessel 6 utilizing vacuum pump 36. The above-described system allows one bed of adsorptive material to be operated in the adsorptive portion of the cycle while another pressure vessel is operated in either the desorption portion of the cycle or is being purged. As discussed earlier, the use of more than one bed of material can provide a steady supply of oxygen-depleted effluent for injection into the solid carbonaceous subterranean formation.

Injection of the Oxygen-Depleted Effluent

The oxygen-depleted effluent is injected into the solid carbonaceous subterranean formation at a pressure higher than the reservoir pressure of the formation. Preferably, the oxygen-depleted effluent is injected at a pressure of from about 500 p.s.i.g. to about 1500 p.s.i.g. above the reservoir pressure of the formation. If the injection pressure is below or equal to the reservoir pressure, the oxygen-depleted effluent typically cannot be injected because it cannot overcome the reservoir pressure. The oxygen-depleted effluent is injected preferably at a pressure below the formation parting pressure of the solid carbonaceous subterranean formation.

If the injection pressure is too high and the formation extensively fractures, injected oxygen-depleted effluent may be lost and less methane may be produced.

However, based on studies of other types of reservoirs, it is believed that oxygen-depleted effluent may be injected into the formation at pressures above the formation parting pressure as long as induced fractures do not extend from an injection well to a production well. In fact, injection above formation parting pressure may be required in order to achieve sufficient injection and/or recovery rates to make the process economical or, in other cases, may be desired to achieve improved financial results when it can be done without sacrificing overall performance. Preferably, the fracture half-length of the induced fractures within the formation is less than from about 20% to about 30% of the spacing between an injection well and a production well. Also, preferably, the induced fractures should be maintained within the formation.

Parameters important to the recovery of methane, such as fracture half-length, fracture azimuth, and height growth can be determined using formation modeling techniques which are known in the art. Examples of the techniques are discussed in John L. Gidley, et al., Recent Advances in Hydraulic Fracturing, Volume 12, Society of Petroleum Engineers Monograph Series, 1989, pp. 25–29 and pp. 76–77; and Schuster, C. L., "Detection Within the Wellbore of Seismic Signals Created by Hydraulic Fracturing", paper SPE 7448 presented at the 1978 Society of Petroleum Engineers' Annual Technical Conference and Exhibition, Houston, Tex., October 1–3. Alternatively, the fracture half-length and impact of its orientation can be assessed using a combination of pressure transient analysis and reservoir flow modeling such as described in SPE 22893, "Injection Above-Fracture-Parting Pressure Pilot, Valhal Field, Norway," by N. Ali et al., 69th Annual Technical Conference and Exhibition of the Society of Petroleum Engineers, Dallas, Tex., Oct. 6–9, 1991. While it should be noted that the above reference describes a method for enhancing oil recovery by injection of water above fracture-parting-pressure, it is believed that the methods and techniques discussed in SPE 22893 can be adapted to enhance the recovery of methane from a solid carbonaceous subterranean formation.

In general, the deeper the solid carbonaceous subterranean formation, the higher the pressure necessary to inject the oxygen-depleted effluent into the formation. Typically, an injection pressure of from about 400 to 2000 p.s.i.g. will be sufficient to inject oxygen-depleted effluent into a majority of the formations from which it is desirable to recover methane using the invention.

The oxygen-depleted effluent is injected into the solid carbonaceous subterranean formation through an injection well in fluid communication with the formation. Preferably, the injection well penetrates the methane-containing formation, but the injection well need not penetrate the formation as long as fluid communication exists between the formation and the injection well. The injection of oxygen-depleted effluent may be either continuous or discontinuous. The injection pressure may be maintained constant or varied.

A fluid comprising methane is recovered from a production well in fluid communication with the formation. As with the injection well, the production well preferably penetrates the methane-containing formation, but the production well need not penetrate the formation as long as fluid communication exists between the formation and the production well. The production well or wells are operated in accordance with conventional coalbed methane recovery wells. It may be desirable to minimize the backpressure on a production well during recovery of fluids comprising methane through that production well. The reduction of back pressure on the production well will assist the movement of the fluid, comprising methane, from the formation to the wellbore.

Preferably, a production well is operated so that the pressure in the production well at a wellbore location adjacent the methane producing formation is less than the initial reservoir pressure of the formation. The wellbore location adjacent the methane producing formation is within the wellbore, not the formation. The initial reservoir pressure is the reservoir pressure near the production well of interest at a time before the initial injection of oxygen-depleted effluent into the formation. The reservoir pressure may increase during the injection of oxygen-depleted effluent, but it is believed that the pressure in the production well near the formation preferably should be maintained less than the initial reservoir pressure. This will enhance the movement of fluid from the formation to the wellbore. Most preferably, the pressure in a production well at a wellbore location adjacent the methane producing formation should be less than about 400 p.s.i.g.

In some instances back-pressure on a production well's wellbore may be preferable, for example, when it is desirable to maintain a higher reservoir pressure to minimize the influx of water into the formation from surrounding aquifers. Such an influx of water into the formation could reduce the methane recovery rate and also complicate the operation of a production well.

Another situation where it can be preferable to maintain back-pressure on a production well's wellbore is when there is concern over the precipitation and/or condensation of solids and/or liquids within the formation near the wellbore or in the wellbore itself. The precipitation and/or condensation of solids or liquids in or near the wellbore could reduce the methane recovery rate from a production well. Examples of materials which may precipitate or condense out near the wellbore and present a problem are occluded oils, such as waxy crudes. It is believed that a higher pressure in the production well's wellbore at a location adjacent to the formation will minimize such precipitation and/or condensation of solids or liquids in or near the wellbore. Therefore, if precipitation and condensation in the wellbore are a problem, it may be preferable to increase the pressure in the production well's wellbore to a value as high as practicable.

Preferably, a solid carbonaceous subterranean formation, as utilized in the invention, will have more than one injection well and more than one production well in fluid communication with the formation.

The timing and magnitude of the increase in the rate of methane recovery from a production well will depend on many factors, including, for example, well spacing, thickness of the solid carbonaceous subterranean formation, cleat porosity, injection pressure and injection rate, injected gaseous fluid composition, sorbed gas composition, reservoir pressure, and cumulative production of methane prior to injection of oxygen-depleted effluent.

When the foregoing parameters are generally held constant, a smaller spacing between an injection well and a production well will result in a faster observable production well response (both an increase in the recovery rate of methane and a shorter time before injected oxygen-depleted effluent appears at a production well) than the response which occurs with an injection well and a production well separated by a larger spacing. When spacing the wells, the desirability of a fast increase in the rate of methane production must be balanced against other factors such as earlier nitrogen breakthrough when utilizing a reduced well spacing and the quantity of oxygen-depleted effluent utilized to desorb the methane from the formation for any given spacing.

If desired, the methane produced in accordance with this invention can be separated from co-produced gases, such as nitrogen or mixtures of nitrogen and any other gas or gases which may have been injected or produced from the solid carbonaceous subterranean formation. Such co-produced gases will, or course, include any gases that occur naturally in solid carbonaceous subterranean formations together with the methane. As discussed earlier, these gases which occur together naturally with the methane are commonly referred to as coalbed methane. These naturally-occurring gases can include, for example, hydrogen sulfide, carbon dioxide, ethane, propane, butane, and heavier hydrocarbons in lesser amounts. If desired, the methane produced in accordance with this invention can be blended with methane from other sources which contain relatively fewer impurities.

The produced methane can be blended with an oxygen-enriched air fraction, such as that co-produced in the physical separation of air into oxygen-rich and oxygen-depleted fractions. This procedure is the subject of co-filed application Ser. No. 08/147,121, which is hereby incorporated by reference. As noted therein, produced methane containing nitrogen or mixtures of nitrogen and other gases can be blended with the oxygen-enriched fraction produced from the production of an oxygen-depleted effluent. Alternatively, the produced methane containing mixture can be conveyed to the point of use for blending with the oxygen-enriched fraction to raise the heating value of the methane blend.

EXAMPLE

A pilot test was conducted which injected oxygen-depleted effluent into a solid carbonaceous subterranean formation. This Example and FIG. 2 demonstrate that it is possible to more than double the rate of methane production from a coalbed by injecting oxygen-depleted effluent into the coalbed to enhance the recovery of methane from the coalbed. A membrane separator was utilized to provide the oxygen-depleted effluent for the pilot test.

In the pilot test two wells were producing from a 20-foot-thick coal seam located approximately 2,700 feet from the surface for about four years prior to injection of oxygen-depleted effluent. During the four year period each of the wells was producing on a pressure-depletion basis (driven by the reservoir pressure). Prior to commencing the pilot test, both the production wells were shut-in and one was converted to an injection well. The production well used during the pilot test was then brought on-line by itself for a short period of time and then shut-in. Its production rate during the short period of time was higher than its previous average production rate of about 200,000 cubic feet of methane per day. It is believed that this transient rate was a result of the earlier shut-in of both production wells.

The pilot test utilized three additional injection wells which were drilled into the same 20-foot-thick coal seam. The five wells of the pilot test can be visualized as a "5 spot" on a die or domino covering an 80-acre square area with the injection wells surrounding the production well (i.e. the injection wells are each about 1800 feet from each other). Oxygen-depleted effluent containing between about 1% and 5% oxygen by volume was compressed to approximately one thousand pounds and injected into the four corner wells at a rate of about 300,000 standard cubic feet per day for several months. Within less than a month, the volume of gas produced from the production well increased to between about 1,200,000 to about 1,500,000 standard cubic feet per day. Over time, the content of the nitrogen increases to over 30% by volume of the total fluids recovered.

Figure 2:
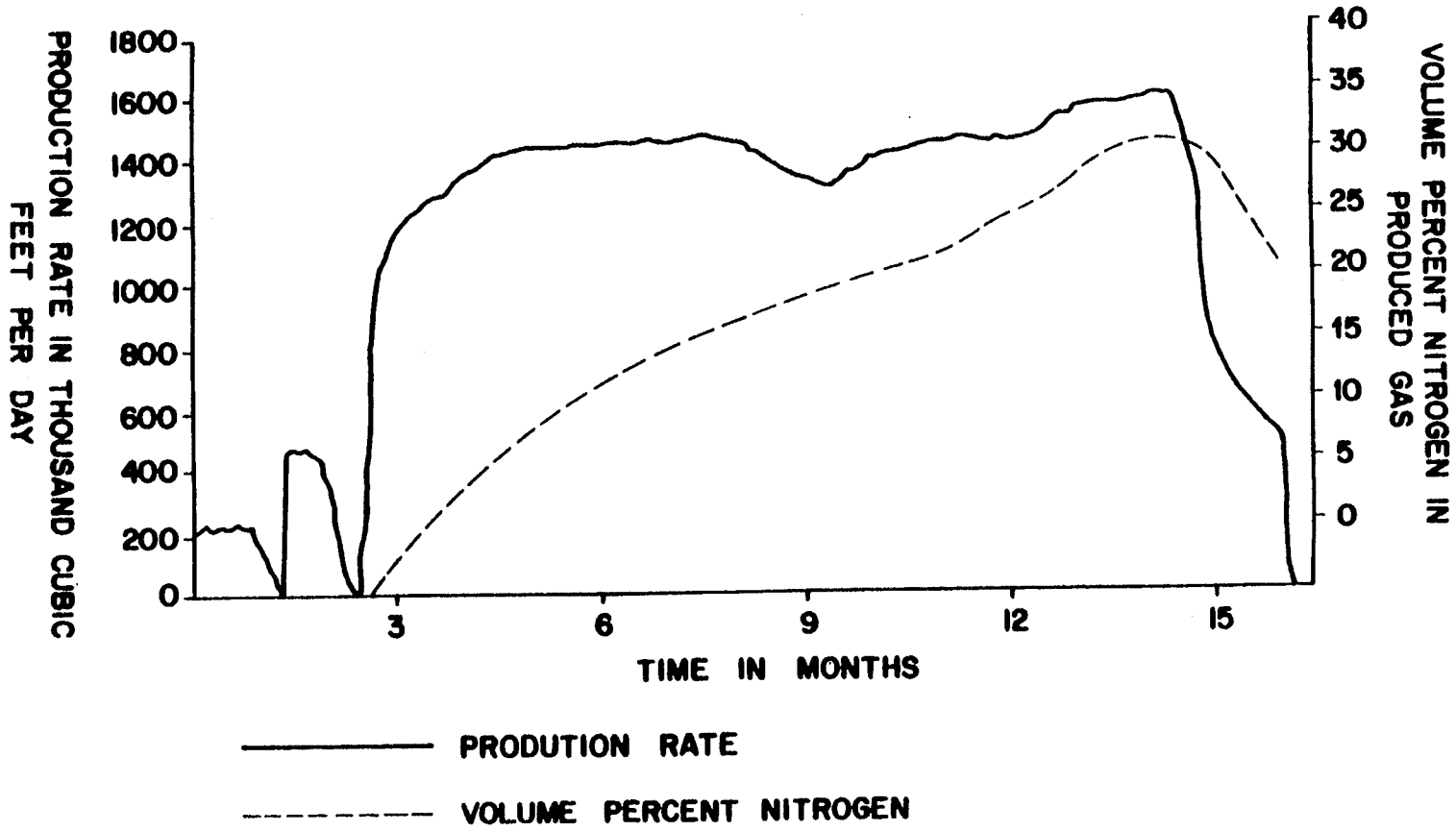
FIG. 2 is a graph of the rate of total fluids recovered over time from a field which utilized oxygen-depleted air to enhance the recovery of methane from a coalbed. The total fluids recovered primarily contain methane and nitrogen, with a small volume percentage of water. The graph also shows the volume percent of nitrogen over time in the total fluids recovered.

The results of the pilot test as shown in the FIG. 2 demonstrate that it is possible to at least double the rate of methane recovery from a solid carbonaceous subterranean formation, such as a coal seam, by injecting oxygen-depleted effluent into the formation. The doubled rate of methane recovery can be maintained for at least twelve months. It was further shown that a recovery rate four times the pre-injection recovery rate could be maintained for at least eleven months, and five times the pre-injection rate could be maintained for at least five months.

Based on the pilot test it is believed that the methane recovery rate can be increased to twice the pre-injection recovery rate within ninety days of commencing injection of oxygen-depleted effluent, preferably within thirty days of commencing injection of oxygen-depleted effluent. It is further believed that the methane recovery rate can be increased to five times its pre-injection value within two months of commencing injection.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made and materials may be substituted for those disclosed described in the application. For example, a zeolitic molecular sieve-type material can be utilized in the pressure swing adsorption separator instead of a carbon molecular sieve-type material.

Thus, it will be appreciated that various modifications, alternatives, variations, etc., may be made without departing from the spirit and scope of the invention as defined in the appended claims. It is, of course, intended that all such modifications are covered by the appended claims.

That which is claimed is:

1. A method of recovering methane from a solid carbonaceous subterranean formation having a production well in fluid communication with the formation and an injection well in fluid communication with the formation, the method comprising the steps of:

(a) injecting a gaseous fluid containing at least 60 volume percent nitrogen and at least 15 volume percent oxygen into a bed of adsorptive material which preferentially adsorbs oxygen over nitrogen to establish a total pressure on the bed of adsorptive material;

(b) removing a raffinate, comprising an oxygen-depleted effluent, from the bed;

(c) injecting the oxygen-depleted effluent from step b) into the solid carbonaceous subterranean formation through the injection well;

(d) recovering a fluid comprising methane through the production well; and (e) operating the production well so that a pressure in the production well at a wellbore location adjacent to the formation is less than an initial reservoir pressure of the formation.

2. The method of claim 1, further comprising the steps of:

(f) lowering the total pressure on the bed of adsorptive material, after a desired degree of saturation of the bed of adsorptive material is obtained, to desorb an oxygen-enriched gaseous mixture from the bed; and (g) removing the gases desorbed in step f) from the bed of adsorptive material and repeating steps a) through c).

3. The method of claim 1, wherein the oxygen-depleted effluent is injected into the solid carbonaceous subterranean formation through the injection well at a pressure lower than a formation parting pressure.

4. The method of claim 2, further comprising applying a vacuum to the bed of adsorptive material after lowering the pressure on the bed of adsorptive material to purge the bed of adsorptive material of adsorbed gases.

5. The method of claim 1, wherein the oxygen-depleted effluent is injected into the solid carbonaceous subterranean formation at a pressure of from about 500 to about 1500 p.s.i.g. above a reservoir pressure of the formation.

6. The method of claim 1, wherein the oxygen-depleted effluent is compressed to about 400 to about 2000 p.s.i.g. before injection into the solid carbonaceous subterranean formation.

7. The method of claim 1, wherein the oxygen-depleted effluent has a nitrogen-to-oxygen volume ratio of at least 9:1.

8. The method of claim 7, wherein the oxygen-depleted effluent contains 2 to 8% by volume oxygen.

9. The method of claim 1, wherein the bed of adsorptive material of step a) comprises carbon molecular sieve material.

10. The method of claim 1, wherein the gaseous fluid injected in step a) comprises a mixture of gases found at the well site.

11. The method of claim 1, wherein the recovered fluid comprises methane and nitrogen.

12. The method of claim 1, wherein the oxygen-depleted effluent contains less than 95% by volume nitrogen.

13. The method of claim 1, wherein the production well is operated so that the pressure in the production well at a wellbore location adjacent to the formation is less than 400 p.s.i.g.

14. A method of recovering methane from a coalbed having a production well in fluid communication with the coalbed and an injection well in fluid communication with the coatbed, the method comprising the steps of:

(a) injecting a gaseous fluid containing at least 60 volume percent nitrogen and at least 15 volume percent oxygen into a bed of adsorptive material which preferentially adsorbs oxygen over nitrogen to establish a total pressure on the bed of adsorptive material;

(b) removing a raffinate, comprising an oxygen-depleted effluent containing less than 95% by volume nitrogen, from the bed;

(c) injecting the oxygen-depleted effluent from step b) into the coalbed through the injection well; and (d) recovering a fluid comprising methane through the production well.

15. The method of claim 14, further comprising:

(e) lowering the total pressure on the bed of adsorptive material, after a desired degree of saturation of the bed of adsorptive material is obtained, to desorb an oxygen-enriched gaseous mixture from the bed; and (f) removing the gases desorbed in step e) from the bed of adsorptive material and repeating steps a) through c).

16. The method of claim 15, further comprising applying a vacuum to the bed of adsorptive material after lowering the pressure on the bed of adsorptive material to purge the bed of adsorptive material of adsorbed gases.

17. The method of claim 14, wherein the oxygen-depleted effluent is injected into the coalbed through the injection well at a pressure lower than a formation parting pressure of the coalbed.

18. The method of claim 14, wherein the oxygen-depleted effluent is injected into the coalbed at a pressure of from about 500 to about 1500 p.s.i.g. above a reservoir pressure of the coalbed.

19. The method of claim 14, wherein the bed of adsorptive material of step a) comprises carbon molecular sieve material.

20. The method of claim 14, wherein the gaseous fluid injected in step a) comprises a mixture of gases found at the well site.

21. The method of claim 14, wherein the fluid recovered comprises methane and nitrogen.

22. A method of increasing the recovery of methane from a coalbed penetrated by an injection well and a production well, which comprises the steps of:

(a) recovering methane from a production well at a pre-injection methane recovery rate;

(b) processing air containing about 15 to 25% by volume oxygen through a pressure swing adsorption separator to produce an oxygen-depleted effluent;

(c) injecting the oxygen-depleted effluent through the injection well at a rate sufficient to increase the recovery of methane from the production well to at least two times the pre-injection methane recovery rate within 90 days of a first injection of oxygen-depleted effluent; and (d) operating the production well so that a pressure in the production well at a wellbore location adjacent to the coalbed is less than an initial reservoir pressure of the coalbed.

23. The method of claim 22, wherein the methane is recovered from the production well at the rate of at least two times the pre-injection methane recovery rate for at least 120 days.

24. The method of claim 22, wherein the methane is recovered from the production well at a rate of at least five times the pre-injection methane recovery rate for at least one hundred fifty days.

25. The method of claim 22, wherein the methane is recovered from the production well at a rate of at least two times the pre-injection methane recovery rate for at least 365 days.

26. The method of claim 22, wherein the recovery of methane from the production well is increased to at least two times the pre-injection methane recovery rate within 30 days of the first injection of oxygen-depleted effluent.

27. The method of claim 22, wherein the recovery of methane from the production well is increased to at least five times the pre-injection methane recovery rate within at least 60 days of the first injection of oxygen-depleted effluent.

28. The method of claim 27, wherein the methane is recovered from the production well at a rate of at least four times the pre-injection methane recovery rate for at least 240 days.

29. A method of increasing the recovery of methane from a coalbed penetrated by an injection well and a production well, which comprises the steps of:

(a) processing air containing about 15 to 25% by volume oxygen through a pressure swing adsorption separator to produce an oxygen-depleted effluent;

(b) injecting the oxygen-depleted effluent into the coalbed through the injection well at a pressure above a formation parting pressure of the coalbed;

(c) recovering a fluid comprising methane through the production well; and (d) operating the production well so that a pressure in the production well at a wellbore location adjacent to the coalbed is less than an initial reservoir pressure of the coalbed.

30. The method of claim 29, further comprising the step of regulating the pressure, at which oxygen-depleted effluent is injected into the coalbed, so that fractures induced within the coalbed by the injection of the effluent in step b) do not extend from the injection well to the production well.

31. The method of claim 29, wherein the oxygen-depleted effluent is injected into the coalbed, so that a fracture half-length of the fractures induced within the coalbed by the injection of the effluent are less than about 30% of a spacing between the injection well and the production well.

* * * * *

UNITED STATES PATENT AND TRADEMARK OFFICE

CERTIFICATE OF CORRECTION

PATENT NO. : 5,388,643

DATED : February 14, 1995

INVENTOR(S) : Dan Yee, Rajen Puri

It is certified that error appears in the above-indentified patent and that said Letters Patent is hereby corrected as shown below:

| Col. | Line | |
|---|---|---|
| 1 | 61 | "U.S. Pat. No. 5,014,785 to Purl, et al." should read --U.S. Pat. No. 5,014,785 to Puri, et al.-- |
| 13 | 63 | "the coatbed," should read --the coalbed,-- |

Signed and Sealed this

Tenth Day of October, 1995

*Attest:*

Bruce Lehman

BRUCE LEHMAN

*Attesting Officer*

*Commissioner of Patents and Trademarks*